US005221006A

United States Patent [19]

Plumlee et al.

[11] Patent Number: 5,221,006

[45] Date of Patent: Jun. 22, 1993

[54] MAGNETIC ARTICLE HOLDER

[76] Inventors: Bille L. Plumlee, 3545 Holmes Rd., Salina, Kans. 67401; Dwight L. Plumlee, 219 Matt Pl., Greensboro, N.C. 67406

[21] Appl. No.: 838,897

[22] Filed: Feb. 21, 1992

[51] Int. Cl.[5] ..... A45C 11/26

[52] U.S. Cl. ..... 206/350; 206/818; 211/DIG. 1; 248/309.4

[58] Field of Search ..... 206/350, 818 X; 335/285; 248/309.4; 211/DIG. 1

[56] References Cited

U.S. PATENT DOCUMENTS

| | | | |
|---|---|---|---|
| 425,768 | 4/1890 | Ezell | 206/818 X |
| 2,580,099 | 12/1951 | Jaeger | 211/DIG. 1 X |
| 2,589,349 | 3/1952 | Diefenbach | 206/818 X |
| 3,029,824 | 4/1962 | Goodell | 248/309.4 X |
| 3,212,546 | 10/1965 | Lind | 335/285 |
| 3,248,167 | 4/1966 | Friedman | 206/350 X |
| 3,642,122 | 2/1972 | Von Ende | 206/818 X |
| 3,650,032 | 3/1972 | Kestler | 206/818 X |
| 3,763,996 | 10/1973 | Shepherd | 206/818 X |
| 4,167,230 | 9/1979 | Barratt | 206/818 X |

FOREIGN PATENT DOCUMENTS

| | | | |
|---|---|---|---|
| 1348460 | 12/1963 | France | 206/818 |
| 1482940 | 4/1966 | France | 206/350 |
| 1220799 | 1/1971 | United Kingdom | 211/DIG. 1 |

*Primary Examiner*—Bryon P. Gehman

*Attorney, Agent, or Firm*—John Wade Carpenter

[57] ABSTRACT

An article holder having a pair of plate members, and a magnetic member or magnet releasably holding the pair of plate members. Each plate member is magnetically attracted to the magnet, and each plate member has a recess wherein articles, such as nuts or bolts or tools are releasably held.

8 Claims, 4 Drawing Sheets

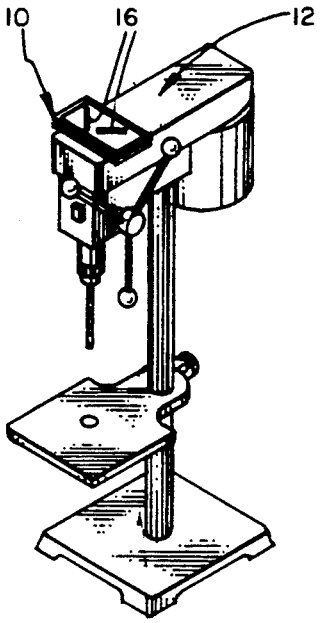
FIG. 1
FIG. 2
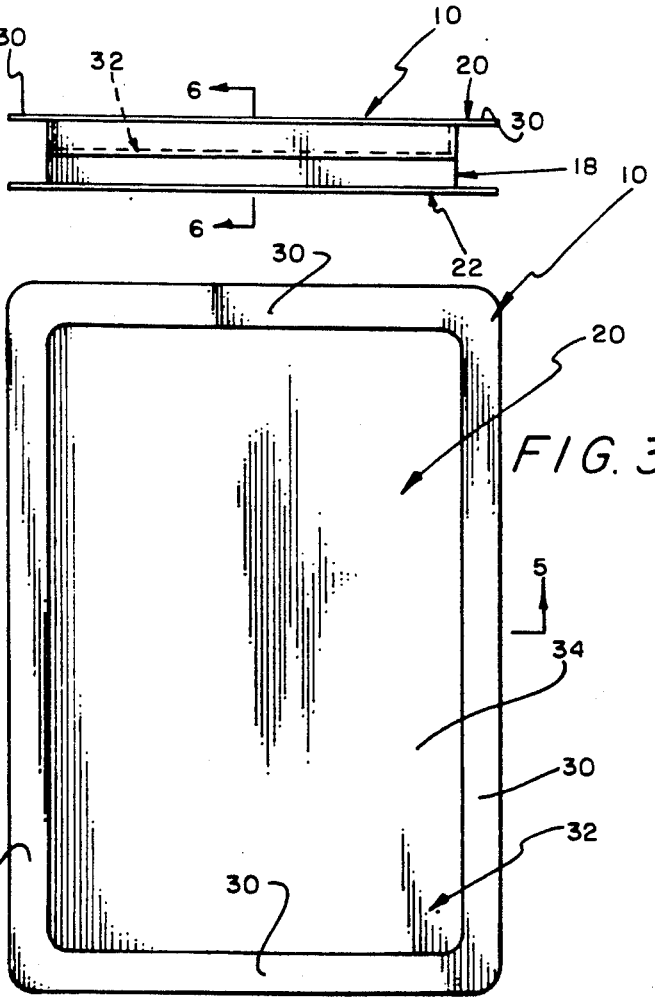
FIG. 3
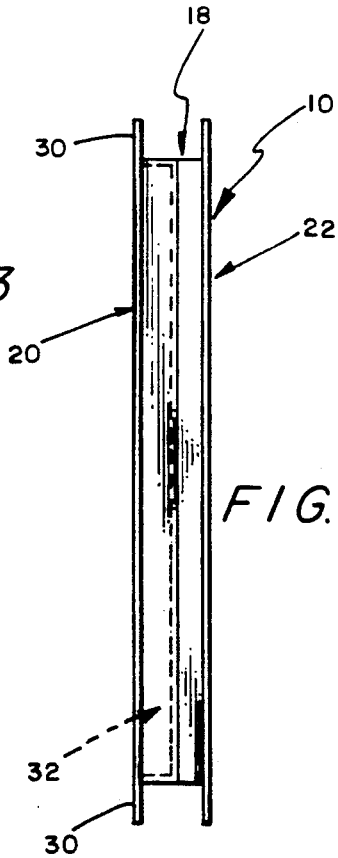
FIG. 4

MAGNETIC ARTICLE HOLDER

FIELD OF THE INVENTION

The present invention is related to an article holder. More specifically, the present invention provides for a magnetic holder for holding such articles as nuts, bolts, tools, etc.

DESCRIPTION OF THE PRIOR ART

A patentability investigation was conducted and the following U.S. Pat. Nos. were discovered:

361,248—titled: HOLDER FOR METAL ARTICLES, Winton 4,169,532—titled: PARTS TRAY, Scapellati 2,580,099—titled: DOUBLE MAGNETIC HOLDING DEVICE, Jaeger 2,733,113—titled: HOLDER FOR TOOLS, MECHANICAL PARTS, AND THE LIKE, Humbargar 2,988,410—titled: TRAY FOR DASHBOARDS OF VEHICLES, Weisz 3,868,016—titled: MAGNETIZED TRAY, Szpur 4,337,860—titled: DETACHABLE WRENCH SET ORGANIZER AND STORAGE UNIT, Carrigan 4,802,580—titled: MAGNETIC SOCKET, Andersen 4,826,059—titled: MAGNETIC TOOL HOLDER, Bosch et al None of the foregoing prior art patents teach the particular magnetic article holder of the present invention.

SUMMARY OF THE INVENTION

The present invention accomplishes its desired objects by broadly providing an article holder comprising a first plate member having a structure defining a first recess; a magnetic member releasably secured to the first plate member; and a second plate member releasably secured to said magnetic member. The second plate member has a structure defining a second recess. The first plate member comprises a generally planar first perimetrical structure terminating in a first recess wall that is secured generally normal to the first perimetrical structure and depending therefrom; and a first recess bottom secured generally normal to said first recess wall. The first recess wall comprises a pair of first side recess walls and a pair of first end recess walls secured to the first side recess walls. A threaded bolt is secured to the second plate member and a bracket member is engaged by the threaded bolt. A nut is threadably engaged to the threaded bolt for retaining the bracket member against the second plate member. The second plate member comprises a generally planar second permetrical structure terminating in a second recess wall that is secured generally normal to the second permetrical structure and depending therefrom, and a second recess bottom secured generally normal to the second recess wall. The second recess wall comprises a pair of second side recess walls and a pair of second end recess walls secured to second side recess walls.

It is therefore an object of the present invention to provide a magnetic article holder.

These, together with the various ancillary objects and features which will become apparent to those skilled in the art as the following description proceeds, are attained by this novel magnetic article holder, a preferred embodiment being shown with reference to the accompanying drawings, by way of example only, wherein:

BRIEF DESCRIPTION OF THE DRAWINGS

FIG. 1 is a perspective view of the magnetic article holder secured on top of a drill;

FIG. 2 is an end elevational view of one embodiment of the magnetic article holder;

FIG. 3 is a top plan view of the magnetic article holder in FIG. 2;

FIG. 4 is a side elevational view of the magnetic article holder in FIG. 2;

DETAILED DESCRIPTION OF THE INVENTION

Figure 10:
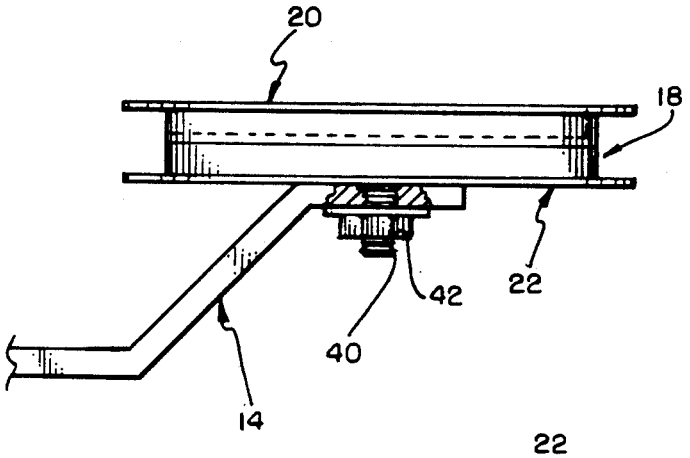
FIG. 10 is a side elevational of the magnetic article holder of FIG. 2 having a nut/bolt assembly secured thereto and engaged to a bracket.

Referring in detail now to the drawings wherein similar parts of the invention are identified by like reference numerals, there is seen an article holder, generally illustrated as 10, which may be mounted on to any suitable object, such as drill 12 (see FIG. 1) or bracket 14 (see FIG. 10. The holder 10 is for holding articles 16 (e.g. nuts, bolts, tools, etc.) as best shown in FIG. 1.

The holder 10, comprises a magnet or magnetic member 18, a first plate member 20 and a second plate member 22 both which are releasably held by the magnet 18. Plate members 20 and 22 are typically manufactured of a material that is attracted to and can be held by a magnet such as magnetic member 18.

First plate member 20 has a perimeter 30 which is typically rectangular in shape and defines the boundaries of a first recess, generally illustrated as 32, wherein articles 16 maybe disposed. Recess 32 is defined by a bottom 34; and a pair of end walls 36—36 and a pair of side walls 38—38, all of which secure to the bottom 34 and to the perimeter 30. The walls 36 and 38 are generally normal or perpendicular to the bottom 34 and to the perimeter 30 and depend downwardly from the latter. Magnet 18 may be strong enough to send magnetic forces or waves through the plate member 20 to hold articles 16 such as those magnetically attractive. Thus, the holder 10 may be operable in the posture shown in FIG. 4.

Figure 5:
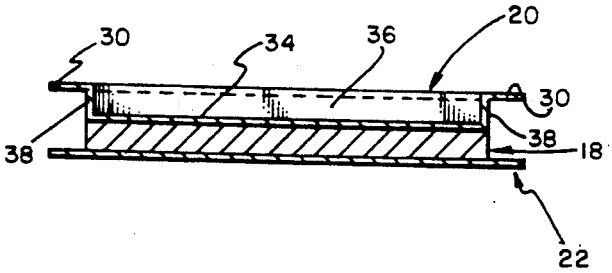
FIG. 5 is a vertical sectional view taken in direction of the arrows and along the plane of line 5—5 in FIG. 3.
Figure 6:
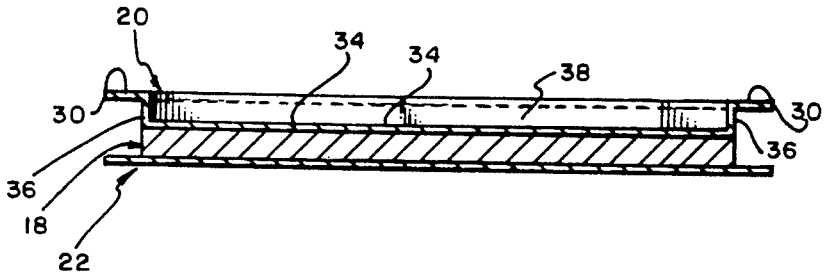
FIG. 6 is a vertical sectional view taken in direction of the arrows and along the plan of line 6—6 in FIG. 2.
Figure 7:
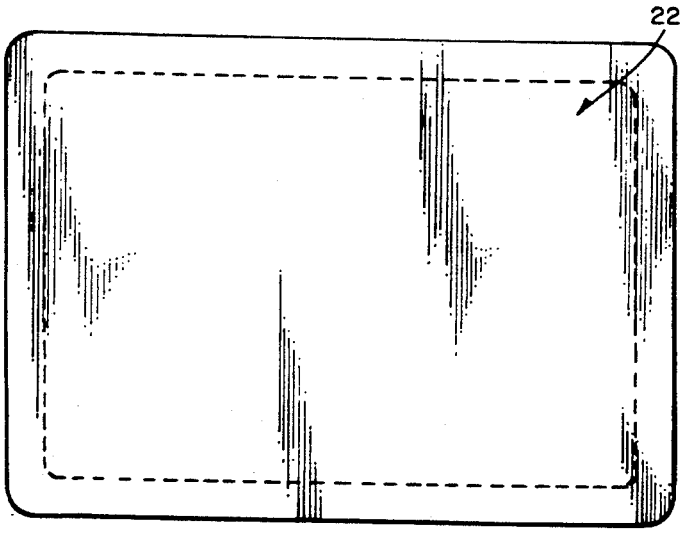
FIG. 7 is a bottom plan view of the embodiment of the magnetic article holder in FIG. 2.
Figure 8:
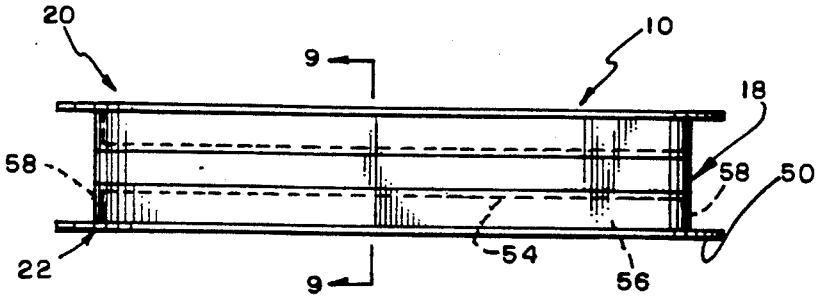
FIG. 8 is a side elevational view of another embodiment of the magnetic article holder.
Figure 9:
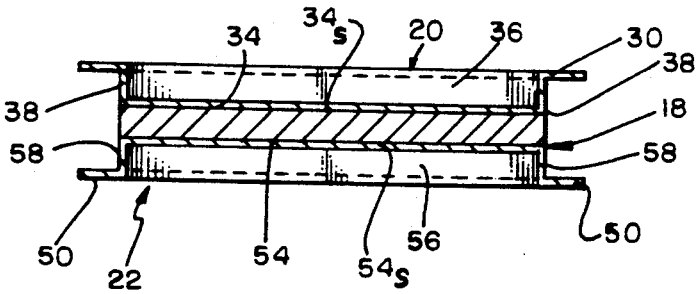
FIG. 9 is a vertical sectional view taken in direction of the arrows and along the plan of line 9—9 in FIG. 8.
Figure 11:
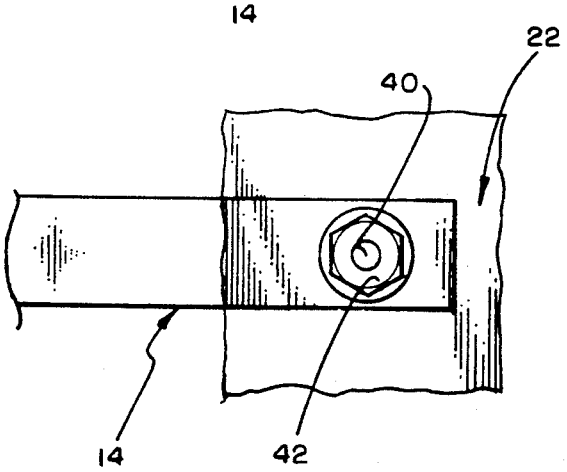
FIG. 11 is a bottom plan view of the holder/bracket assembly in FIG. 10.
Figure 12:
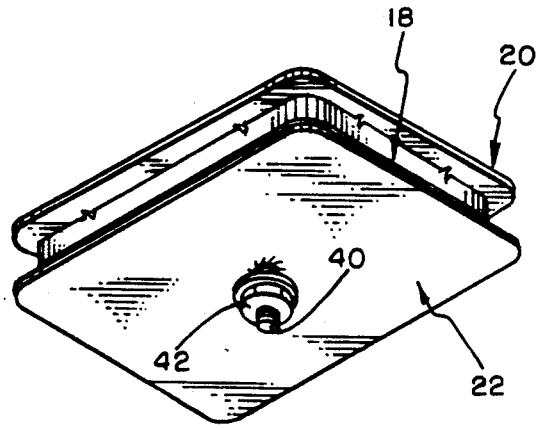
FIG. 12 is a perspective view of the magnetic article holder of FIG. 2 having a nut/bolt assembly secured thereto.
Figure 13:
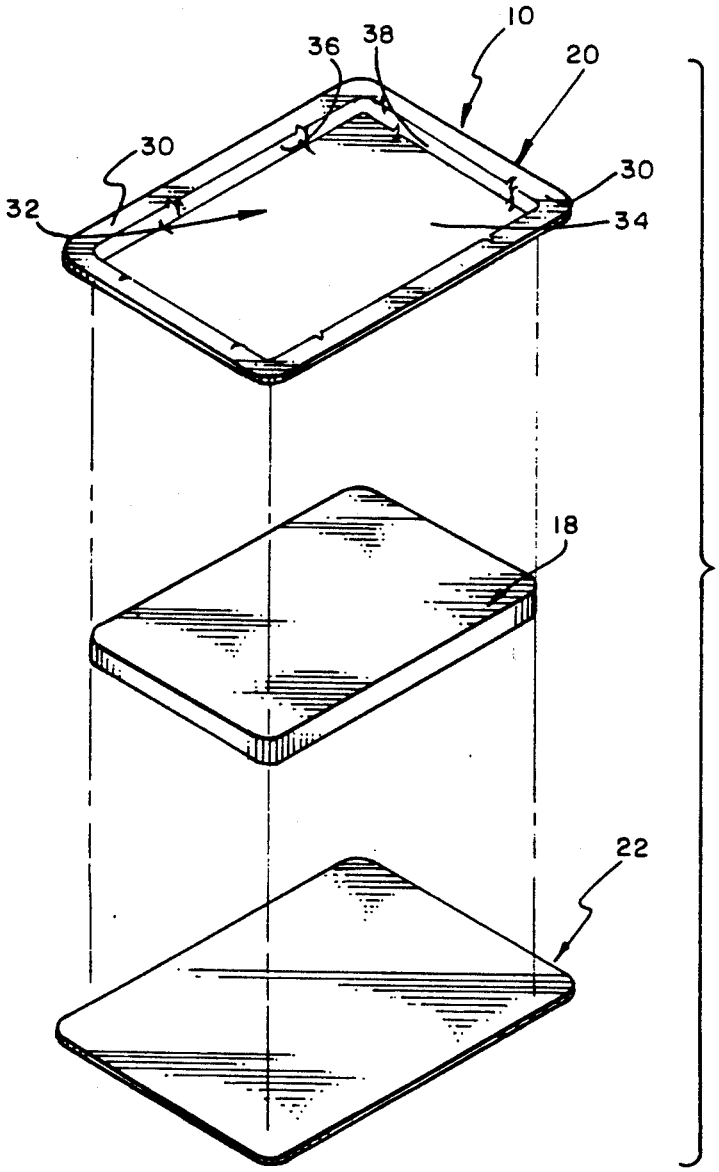
FIG. 13 is an exploded segmented or disassembled perspective view of the magnetic article holder of FIG. 8–9.
Figure 14:
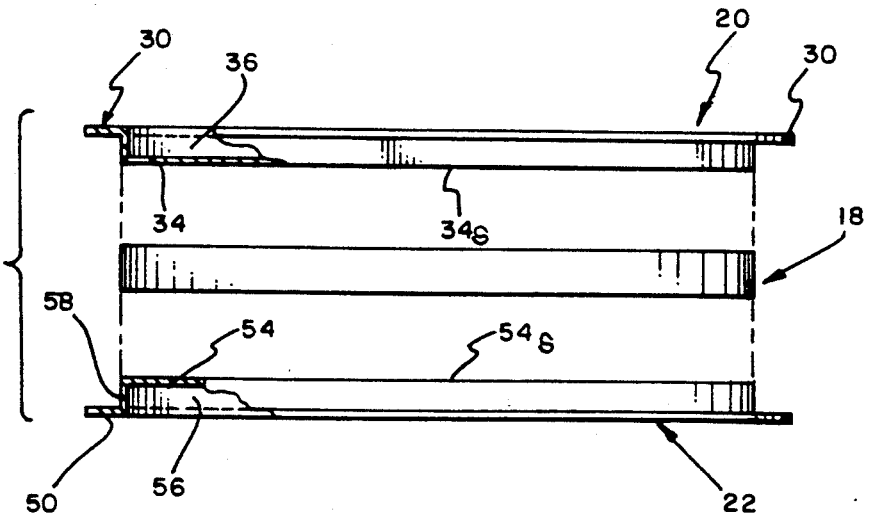
FIG. 14 is a segmented side elevational view of the magnetic article holder of FIG. 13.

The second plate member 22 has two embodiments. In the embodiment depicted in FIGS. 1–7, the second plate member 22 is a flat planar member as best shown in FIGS. 6–7. A threaded bolt 40 may be secured to the flat planar member (as best shown in FIGS. 10, 11 and 12) for engaging the bracket 14 (see FIGS. 10–11) and held thereto by a nut 42 which threadably engages the threaded bolt 40. In the embodiment depicted in FIGS. 8–9 and 14, the second plate member 22 is identical to the first plate member 20. More specifically with respect to this latter embodiment, the second plate member 22 comprises a perimeter 50 which is typically rectangular in shape and defines the boundaries of a second recess, generally illustrated as 52, wherein the articles 16 may also be disposed. Recess 52 is defined by a bottom 54; and a pair of end walls 56—56 and a pair of side walls 58—58, all of which secure to the bottom 54 and to the perimeter 50. The walls 56 and 58 are generally normal or perpendicular to the bottom 54 and to the perimeter 50 and depend downwardly from the latter. As best shown in FIGS. 9 and 14, bottoms 34 and 54 respectfully have bottom outer sides 34*s* and 54*s* which releasably secure to the magnet 18. The first pate 20 and the second plate 22 are not in contact with each other (e.g. plates 20 and 22 are not pivotally secured to each other). As was seen for the first plate member 20, magnet 18 may be strong enough to send magnetic forces or waves through the plate member 22 to hold articles 16 in the recess 52 even if the holder 10 is in the position of FIG. 4.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. An article holder comprising a first plate member having a structure defining a first recess; a magnetic member releasably secured to said first plate member; and a second plate member releasably secured to said magnetic member; said first plate member comprises a generally planar first perimetrical structure terminating in a first recess wall that is secured generally normal to said first perimetrical structure and depending therefrom, and a first recess bottom secured generally normal to said first recess wall; said first recess wall comprises a pair of first side recess walls and a pair of first end recess walls secured to said first side recess walls; a threaded bolt secured to said second plate member, a bracket member engaged by said threaded bolt, and a nut threadably engaged to said threaded bolt for retaining said bracket member against said second plate member.

2. The article holder of claim 1 wherein said second plate member has a structure defining a second recess.

3. The article holder of claim 2 wherein said first plate member comprises a generally planar first perimetrical structure terminating in a first recess wall that is secured generally normal to said first perimetrical structure and depending therefrom, and a first recess bottom secured generally normal to said first recess wall.

4. The article holder of claim 3 wherein said first recess wall comprises a pair of first side recess walls and a pair of first end recess walls secured to said first side recess walls.

5. The article holder of claim 4 wherein said second plate member comprises a generally planar second perimetrical structure terminating in a second recess wall that is secured generally normal to said second perimetrical structure and depending therefrom, and a second recess bottom secured generally normal to said second recess wall.

6. The article holder of claim 5 wherein said second recess wall comprises a pair of second side recess walls and a pair of second end recess walls secured to said second side recess walls.

7. An article holder comprising a first plate member having a structure defining a first recess; a magnetic member releasably secured to said first plate member; and a second plate member releasably secured to said magnetic member; said second plate member has a structure defining a second recess; said first plate member comprises a generally planar first perimetrical structure terminating in a first recess wall that is secured generally normal to said first perimetrical structure and depending therefrom, and a first recess bottom having a first bottom outer side and secured generally normal to said first recess wall; said first recess wall comprises a pair of first side recess walls and a pair of first end recess walls secured to said first side recess walls; said second plate member comprises a generally planar second perimetrical structure terminating in a second recess wall that is secured generally normal to said second perimetrical structure and depending therefrom, and a second recess bottom having a second bottom outer side and secured generally normal to said second recess wall; said second recess wall comprises a pair of second side recess walls and a pair of second end recess walls secured to said second side recess walls and said magnetic member being releasably secured to said first bottom outer side and to said second bottom outer side.

8. The article holder of claim 7 wherein said first plate member is separated from said second plate member.

* * * * *